US012055003B2

(12) United States Patent
Towers et al.

(10) Patent No.: US 12,055,003 B2
(45) Date of Patent: Aug. 6, 2024

(54) ADVANCED LOADING METHOD FOR BALL ROTATION CUTTING AND METHOD OF USE THEREFOR

(71) Applicant: Halliburton Energy Services, Inc., Houston, TX (US)

(72) Inventors: Darrin Nathaniel Towers, Shady Shores, TX (US); Kenneth Lemoine Schwendemann, Flower Mound, TX (US); Benjamin Thomas Derryberry, Mesquite, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 285 days.

(21) Appl. No.: 17/600,002

(22) PCT Filed: Apr. 29, 2019

(86) PCT No.: PCT/US2019/029685
§ 371 (c)(1),
(2) Date: Sep. 29, 2021

(87) PCT Pub. No.: WO2020/222753
PCT Pub. Date: Nov. 5, 2020

(65) Prior Publication Data
US 2022/0145717 A1 May 12, 2022

(51) Int. Cl.
*E21B 29/08* (2006.01)
*E21B 34/14* (2006.01)

(52) U.S. Cl.
CPC ..... *E21B 29/08* (2013.01); *E21B 34/14* (2013.01)

(58) Field of Classification Search
CPC ..... E21B 29/00; E21B 29/08; E21B 34/14
See application file for complete search history.

(56) References Cited

U.S. PATENT DOCUMENTS 3,200,837 A * 8/1965 Brown ..... E21B 34/08 137/496
3,741,249 A * 6/1973 Leutwyler ..... E21B 34/101 251/188

(Continued)

FOREIGN PATENT DOCUMENTS

| | | | |
|---|---|---|---|
| GB | 2340860 | A | 3/2000 |
| WO | 2009026737 | A1 | 3/2009 |
| WO | 2014161207 | A1 | 10/2014 |

OTHER PUBLICATIONS

Lentz, R. D., "Optimization of a Pin-and-Slot Ball Valve Linkage: with an Application to Wireline Cutting in Downhole Oil Well Tools," MIT Jun. 1999, Submitted to the Department of Mechanical Engineering in partial fulfillment of the requirements for the degrees of Master of Science in Mechanical Engineering, 100 pages.

*Primary Examiner* — Umashankar Venkatesan
(74) *Attorney, Agent, or Firm* — John Wustenberg; Parker Justiss, P.C.

(57) ABSTRACT

Provided is a valve assembly and method for opening and closing thereof. The valve assembly, in one aspect, includes a valve body having inlet and outlet flow passageways connected by a valve chamber, and a ball valve member having a bore there through creating a ball/bore interface, the ball valve member located in the valve chamber for selective rotation between valve open and valve closed positions to control flow through the valve assembly. The valve assembly, according to this aspect, includes a linear actuation member slideable to engage proximate the ball/bore interface to assist in moving the ball valve member to the valve closed position.

21 Claims, 7 Drawing Sheets

(56) References Cited

U.S. PATENT DOCUMENTS 3,826,462 A * 7/1974 Taylor ..... E21B 34/105 166/324
3,955,624 A * 5/1976 Fredd ..... E21B 34/16 166/239
3,976,136 A * 8/1976 Farley ..... E21B 34/10 166/336
3,993,136 A * 11/1976 Mott ..... F16K 5/0652 137/461
4,225,110 A 9/1980 Akkerman et al.
4,230,185 A * 10/1980 Fredd ..... E21B 34/12 166/332.3
4,254,836 A * 3/1981 Russell ..... E21B 34/08 175/218
4,278,130 A * 7/1981 Evans ..... E21B 49/087 166/332.3
4,289,165 A * 9/1981 Fredd ..... E21B 34/14 166/324
4,361,308 A * 11/1982 Buss ..... F16K 31/05 192/141
4,415,027 A * 11/1983 Russell ..... E21B 34/10 166/321
4,421,172 A * 12/1983 McMahan ..... E21B 34/12 166/334.2
5,037,062 A 8/1991 Neuhaus
5,050,839 A * 9/1991 Dickson ..... E21B 34/10 166/324
5,551,665 A * 9/1996 Noack ..... E21B 29/08 251/315.1
5,992,520 A * 11/1999 Schultz ..... E21B 34/063 166/332.3
7,086,467 B2 8/2006 Schlegelmilch et al.
7,703,541 B2 * 4/2010 Parks ..... E21B 34/14 166/334.4
8,684,099 B2 * 4/2014 Azimi ..... E21B 34/14 166/332.3
9,127,524 B2 9/2015 Dahlem et al.
9,255,466 B2 * 2/2016 Javed ..... E21B 43/10
10,895,127 B2 * 1/2021 Moyes ..... E21B 34/14
11,414,957 B2 * 8/2022 Reid ..... F16K 5/0605
11,739,612 B2 * 8/2023 Elston ..... E21B 34/14 166/373
2010/0051847 A1 3/2010 Mailand et al.
2012/0138834 A1 6/2012 Tortel et al.
2014/0175317 A1 6/2014 Tennant
2017/0370170 A1 12/2017 Rytlewski

* cited by examiner

ADVANCED LOADING METHOD FOR BALL ROTATION CUTTING AND METHOD OF USE THEREFOR

CROSS-REFERENCE TO RELATED APPLICATION

This application is the National Stage of, and therefore claims the benefit of, International Application No. PCT/2019/029685 filed on Apr. 29, 2019, entitled "ADVANCED LOADING METHOD FOR BALL ROTATION CUTTING AND METHOD OF USE THEREOF," which was published in English under International Publication Number WO 2020/222753 on Nov. 5, 2020. The above application is commonly assigned with this National Stage application and is incorporated herein by reference in its entirety.

BACKGROUND

Operations performed and equipment utilized in conjunction with a subterranean production often requires one or more different types of valves. One such valve is a ball valve. A ball valve is a type of valve that uses a spherical ball valve member as a closure mechanism. The ball valve member has a bore there through that is aligned with the direction of flow when the valve is opened and misaligned with the direction of flow when the valve is closed.

Ball valves have many applications in well tools for use downhole in a wellbore, for example, as formation tester valves, safety valves, and in other downhole applications. Many of these well tool applications use a ball valve because their ball valve members can have a large bore for passage of tools, tubing strings, and flow, yet may also be compactly arranged. For example, ball valves may have a cylindrical outer profile that corresponds to the cylindrical outer profile of the remainder of the tools that it associates with.

When the ball is in the "closed" position, it typically seals against a seat and does not allow fluid to pass through it. When the ball is in the "open" position (e.g., rotated through an angle of about 90°), it allows fluid to pass through it. Debris and/or other objects may be present in an open valve. As the valve begins to close, the debris and/or other objects therein may cause problems with the valve fully closing. Therefore, there exists a need for a ball valve or ball valve assembly that can better handle the debris and/or other objects.

BRIEF DESCRIPTION

Reference is now made to the following descriptions taken in conjunction with the accompanying drawings, in which.

DETAILED DESCRIPTION

Figure 1:
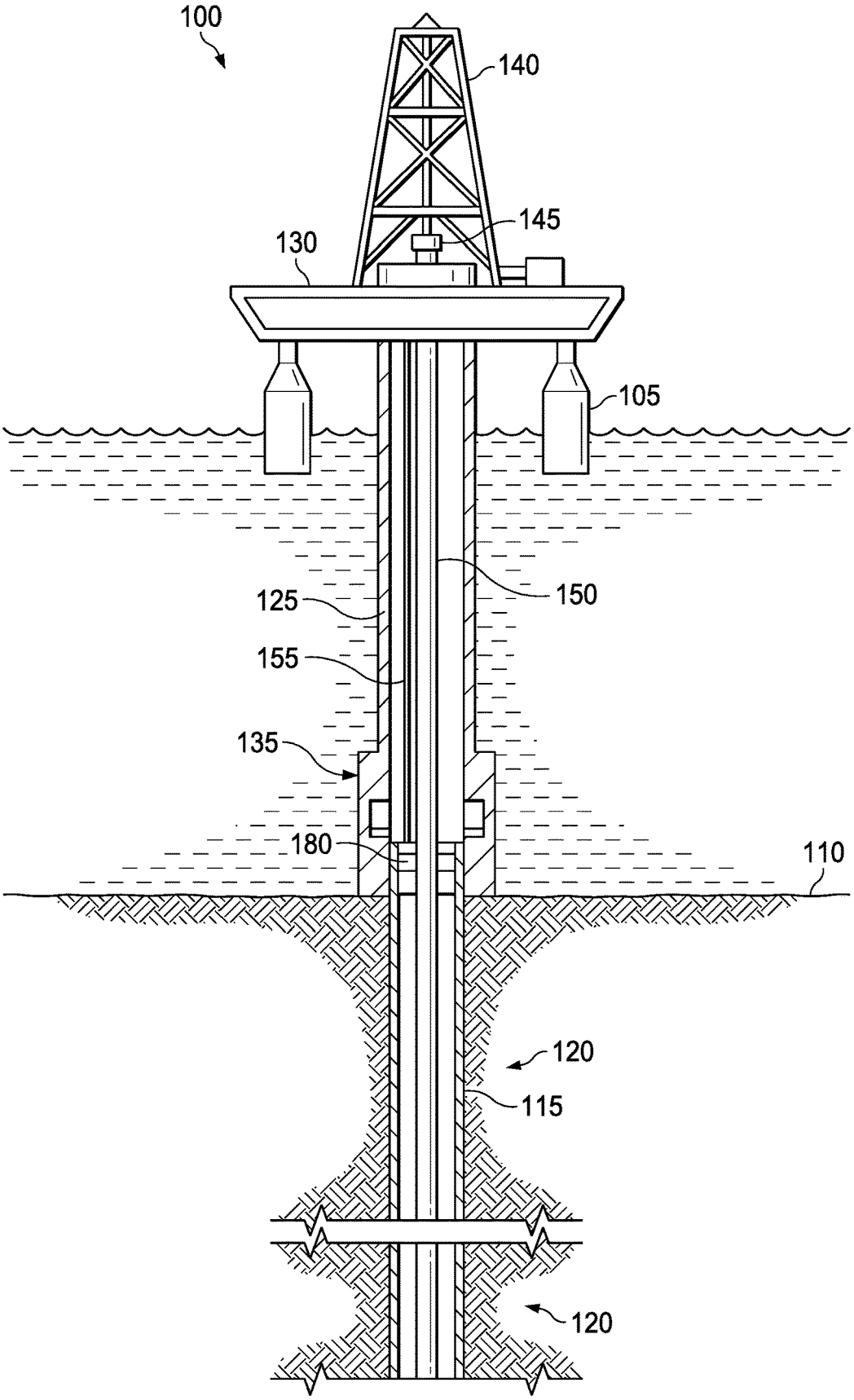
FIG. 1 illustrates a cross-sectional view of an example subterranean production well incorporating a valve assembly that has been manufactured and designed according to the disclosure.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water, such as ocean or fresh water.

The description and drawings included herein merely illustrate the principles of the disclosure. It will thus be appreciated that those skilled in the art will be able to devise various arrangements that, although not explicitly described or shown herein, embody the principles of the disclosure and are included within its scope.

The present disclosure acknowledges the problems inherent to cutting coil tubing, wireline, slickline, etc. positioned in a valve assembly (e.g., in a subsea safety system). The present disclosure further acknowledges the importance of being able to safely shut in a well with a subsea safety system even while coil tubing or wireline is located in the bore of the well. For instance, the coil tubing, wireline, slickline, etc. must be quickly and precisely severed as the safety valve closes and seals the well. The current practice is to use high pressure on the subsea safety system close lines to accomplish a cut. The high pressure is applied to a piston that imparts force to rotational pins connected to a ball valve. The present disclosure further acknowledges that the high forces required to cut the coil tubing, wireline, slickline, etc. can produce loads on the rotation mechanism sufficient to damage to the valve (e.g., typically the damage is to pins, ball and trunnions used to rotate the ball valve).

Based upon the foregoing acknowledgments, the present disclosure has, for the first time, designed a valve assembly that splits up the normal rotation motion from the cutting rotational motion. An improved valve assembly according to the disclosure, thus, permits the cutting actuator to apply loads to the ball valve at the outer edge of the ball away from the center of rotation, thus increasing the potential cutting capacity of the valve.

A valve assembly, in accordance with the principles of the disclosure, includes a valve body having inlet and outlet flow passageways connected by a valve chamber. The valve assembly additionally includes a ball valve member having a bore there through creating a ball/bore interface, the ball valve member located in the valve chamber for selective rotation between the valve open and valve closed positions to control flow through the valve assembly. According to the disclosure, the valve assembly additionally includes a linear actuation member slideable to engage proximate the ball/bore interface to assist in moving the ball valve member to the valve closed position. In accordance with one embodiment, the linear actuation member is a separate secondary linear actuation member, and the valve assembly additionally includes a primary actuation member. In this configuration, the primary actuation member rotates the ball valve member from the valve open position toward the valve closed position, and the secondary linear actuation finalizes the movement of the ball valve member to the valve closed position.

Thus, a valve assembly according to the disclosure incorporates a linear actuation member that produces additional rotational force to the ball valve when a cut is necessary. The linear actuation member, in one example, acts on the outer edge of the ball/bore interface after the valve is partial closed delivering significant additional rotational torque to the ball at a point when it could be cutting coil tubing, wireline, slickline, etc. The force to operate the linear actuation member can be applied through hydraulics, pneumatic, an electric actuator, or a propellant charge, among others.

FIG. 1 depicts a cross-sectional view of an example subterranean production well 100 incorporating a valve assembly 180 that has been manufactured and designed according to the disclosure. A floating workstation 105 (e.g., an oil platform or an offshore platform) can be centered over a submerged oil or gas well located in a sea floor 110 having a wellbore 115. The wellbore 115 may extend from the sea floor 110 through one or more subterranean formations 120. A subsea conduit 125 can extend from a deck 130 of the floating workstation 105 into a wellhead installation 135. The floating workstation 105 can have a derrick 140 and a hoisting apparatus 145 for raising and lowering tools to drill, test, complete, and produce the subterranean production well 100. The floating workstation 105 can be an oil platform as depicted in FIG. 1 or an aquatic vessel capable of performing the same or similar drilling, testing, completing and producing operations. In some examples, the processes described herein can be applied to a land-based environment for wellbore drilling, testing, completing and producing.

A downhole conveyance 150 can be lowered into the wellbore 115 of the oil or gas well during a drilling, completion and/or production stage of the subterranean production well 100. The specific downhole conveyance 150 that may be lowered into the wellbore 115 may vary greatly depending on the stage of completion of the subterranean production well 100. The downhole conveyance 150, in one embodiment, can include a drill string, as well as other tools positioned along the drill string that are usable for testing and drilling operations. These tools may include measuring-while-drilling ("MWD") and logging-while drilling ("LWD") tools and devices. Additionally, upon completion of the wellbore 115, other downhole conveyance 150 may also be lowered into the wellbore 115. For example, wireline and wireline logging and formation testers may be lowered into the wellbore 115, wellbore stimulation equipment may be lowered into the wellbore 115, production and/or coiled tubing and equipment may be lowered into the wellbore 115, and any other tools usable during drilling, completion, and production within the wellbore 115 may also be lowered into the wellbore 115.

The valve assembly 180 may be coupled to the floating workstation 105 via a connection 155. The connection 155 may include a variety of different connections and remain within the scope of the disclosure. In one embodiment, the connection 155 is an electrical connection configured to initiate an opening or closing of the valve assembly 180 (e.g., providing power to the primary actuation member). In another embodiment, the connection 155 is one or more fluid connections configured to initiate an opening or closing of the valve assembly 180 (e.g., a hydraulic open line and/or a hydraulic closed line). In yet another embodiment, the connection 155 is a control line configured to initiate an opening or closing of the valve assembly 180 (e.g., providing a signal to the separate linear actuation member). In even yet another embodiment, the connection 155 is a collection of two or more of the above-discussed connections, among other possible connections.

The valve assembly 180 is controllable from a fully open position (e.g., as illustrated in FIG. 1), to a fully closed position, or to any number of positions between fully open and fully closed. In the fully open position or in a partially open position, the valve assembly 180 provides a path for the wellbore tool 150 or other downhole tools and conveyance mechanisms to travel downhole. In the fully closed position, the valve assembly 180 closes the path for the downhole conveyance 150 or other downhole tools and conveyance mechanisms to travel downhole. Additionally, the fully closed position of the valve assembly 180 isolates a portion of the wellbore 115 that is downhole from the valve assembly 180 from the subsea conduit 125 located uphole the valve assembly 180. That is, in the fully closed position, the valve assembly 180 provides a seal along a fluid path of the wellbore 115.

In one or more examples, the valve assembly 180 is able to cut coil tubing (not shown), wireline (not shown), slickline (not shown), or certain other downhole conveyance 150 elements when the valve assembly 180 transitions to the fully closed position while the downhole conveyance mechanisms are located within the path of the valve assembly 180. In this manner, the valve assembly 180 is able to isolate a downhole portion of the wellbore 115 from the subsea conduit 125, even when a downhole conveyance is positioned within the wellbore 115.

As illustrated, the valve assembly 180 may be positioned within the wellhead installation 135. For example, the valve assembly 180 may be coupled to a blowout preventer (BOP) component (not shown) of the wellhead installation 135. In additional examples, one or more of the valve assemblies 180 may be positioned anywhere along the subsea conduit 125 and the wellbore 115. The isolation and auto-close capabilities of the valve assembly 180 in a compact form factor may enable the valve assembly 180 to operate as a primary well-control barrier. Additionally, the actuation of the valve assembly 180 provides fast actuation and shearing capabilities (e.g., for wireline, slickline, and coil tubing)

usable at the wellhead installation 135 in a subsea environment or as a downhole barrier valve in a land-based or subsea environment.

Figure 2:
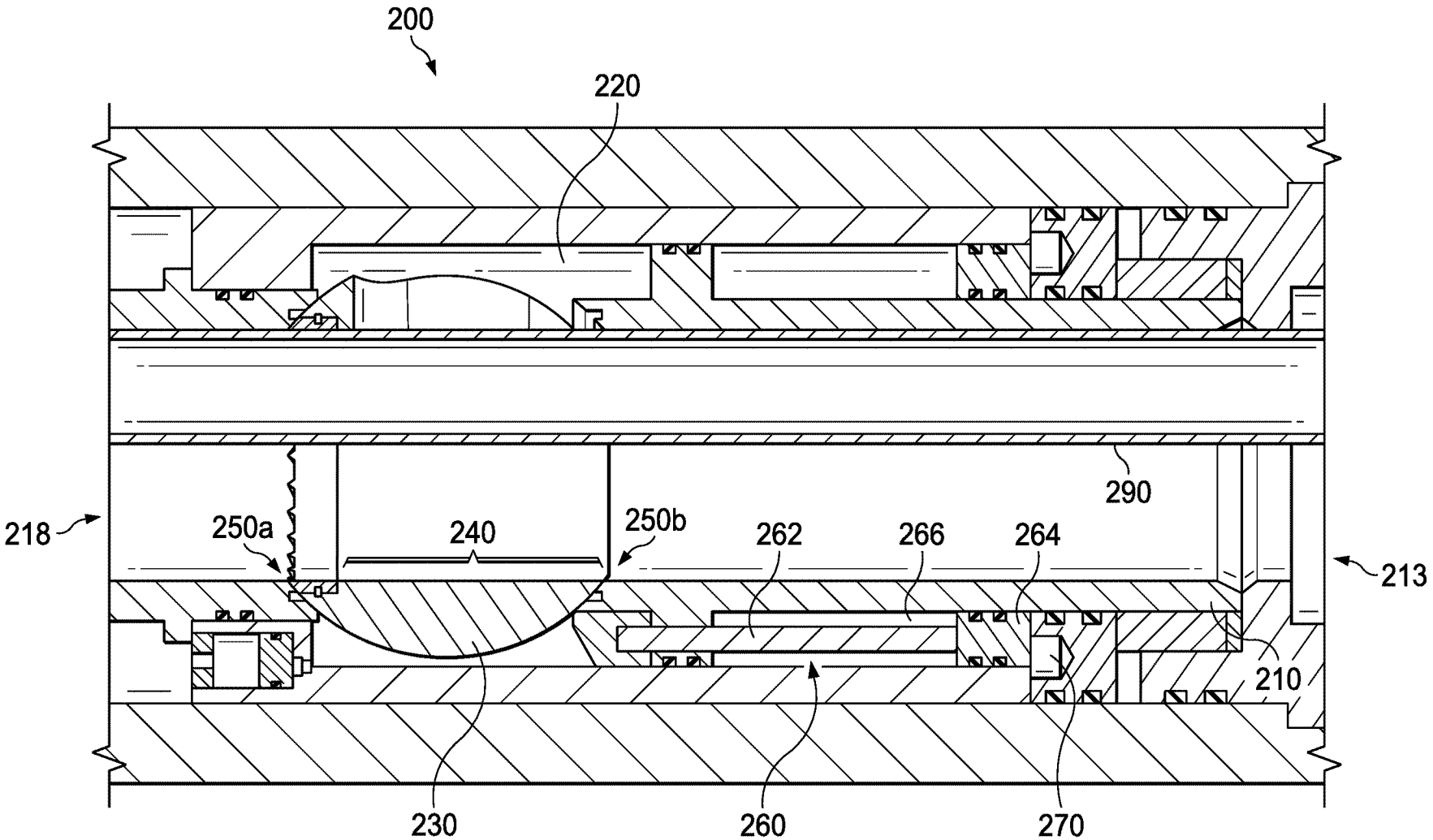
FIG. 2 illustrates a sectional view of one embodiment of a valve assembly manufactured and designed according to the disclosure.

Turning to FIG. 2, illustrated is a sectional view of one embodiment of a valve assembly 200 manufactured and designed according to the disclosure. The valve assembly 200, in the embodiment shown, includes a valve body 210 having an inlet flow passage way 213 and an outlet fluid passage way 218. While the inlet flow passageway 213 and outlet flow passageway 218 have been illustrated on the right and left sides of the valve body 210, respectively, those skilled in the art understand that in certain configurations the opposite may be true.

The inlet flow passageway 213 and outlet flow passageway 218, in the illustrated embodiment, are connected by a valve chamber 220. Positioned in the valve chamber 220, in the illustrated embodiment of FIG. 2, is a ball valve member 230. In accordance with the disclosure, the ball valve member 230 includes a bore 240 there through. As a result of the bore 240 extending through the ball valve member 230, a ball/bore interface 250 is formed. The ball/bore interface 250, as illustrated, may include a leading edge ball/bore interface 250*a*, as well as a trailing edge ball/bore interface 250*b*. The term "leading edge", as used in this context, is intended to mean the ball/bore interface 250*a* that would first encounter/cut objects (e.g., wireline, coil tubing, etc.) that may be located within the bore as the ball valve member 230 is attempting to close. In many designs, the leading edge ball/bore interface 250*a* would be most proximate an uphole end of the valve assembly 200 when the ball valve member 230 is in the valve open position. The term "trailing edge", as used in this context, is intended to mean the ball/bore interface 250*b* opposite the leading edge ball/bore interface 250*a*. In many designs, the trailing edge ball/bore interface 250*b* would be most proximate a downhole end of the valve assembly 200 when the ball valve member 230 is in the valve open position.

The valve assembly 200 illustrated in FIG. 2 additionally includes a linear actuation member 260. The linear actuation member 260, in the illustrated embodiment, is slideable to engage proximate one or more of the ball/bore interfaces 250*a*, 250*b*. The term "proximate" as that term is used with regard to engaging the ball/bore interface, means that the engagement occurs within 30 degrees of the ball/bore interface 250. In certain other embodiments, the engagement occurs within 15 degrees of the ball/bore interface 250, and in certain other embodiments within 7.5 degrees of the ball/bore interface 250. In the illustrated embodiment of FIG. 2, the linear actuation member 260 is slideable to engage the trailing edge of the ball/bore interface 250*b*. In other embodiments of the disclosure, the linear actuation member 260 is slideable to engage the leading edge of the ball/bore interface 250*a*.

The linear actuation member 260 may comprise a variety of different configurations and remain within the purview of the disclosure. In the illustrated embodiment of FIG. 2, however, the linear actuation member 260 comprise a push rod 262 that is coupled to a piston 264 located within a piston chamber 266. In this configuration, the push rod 262 may slide to engage the trailing edge of the ball/bore interface 250*b*. In other embodiments, a pull rod could be used to pull a leading edge of the ball/bore interface 250*a* when the linear actuation member 260 slides.

The linear actuation member 260 may be actuated using a variety of different techniques. In one embodiment, such as that shown in FIG. 2, a propellant charge 270 may be detonated to deploy the linear actuation member 260 from its initial state to a state where it engages with the ball/bore interface 250. When the propellant charge 270 is used, pressure will create against a back side of the piston 264, thereby forcing the push rod 262 via the piston 264 to engage with the ball/bore interface 250, and thus assist in moving the ball valve member 230 to the valve closed position. Given the nature of the propellant charge 270, and the existence of high pressures within the wellbore, as the heat from the detonation dissipates, the push rod 262 and piston 264 may reset to their initial state. In an alternative embodiment, the wellbore pressure may be intentionally increased to reset the linear actuation member 260 to its initial state. Those skilled in the art understand the various different mechanisms and/or steps that may be used/taken to intentionally increase the wellbore pressure to reset the linear actuation member 260. In certain other alternative embodiments, a return mechanism (not shown) may be embodied with the linear actuation member 260 to reset it to its initial state.

In an alternative embodiment, which is not specifically shown in FIG. 2, pneumatics and/or hydraulics could be employed to deploy the linear actuation member 260 from its initial state to a state where it engages with the ball/bore interface 250. In these embodiments, one or more pneumatic or hydraulic lines could be coupled to one or more sides of the piston 264. As those skilled in the art appreciate, the one or more pneumatic or hydraulic lines may be used to create a pressure differential across the piston 264, thereby forcing the piston 264 and push rod 262 to engage with the ball/bore interface 250, and thus assist in moving the ball valve member 230 to the valve closed position. To return the piston 264 and push rod 262 to their initial state, the pressure differential across the piston 264 may be removed, or possible reversed. In yet another alternative embodiment, the linear actuation member 260 is an electrically deployable actuator (e.g., electric ball screw in one embodiment) that engages the ball bore interface 250. While a number of different linear actuation members 260 have been illustrated and/or described, those skilled in the art understand the myriad of other implementations that might be used and remain within the scope of the disclosure.

Figure 3:
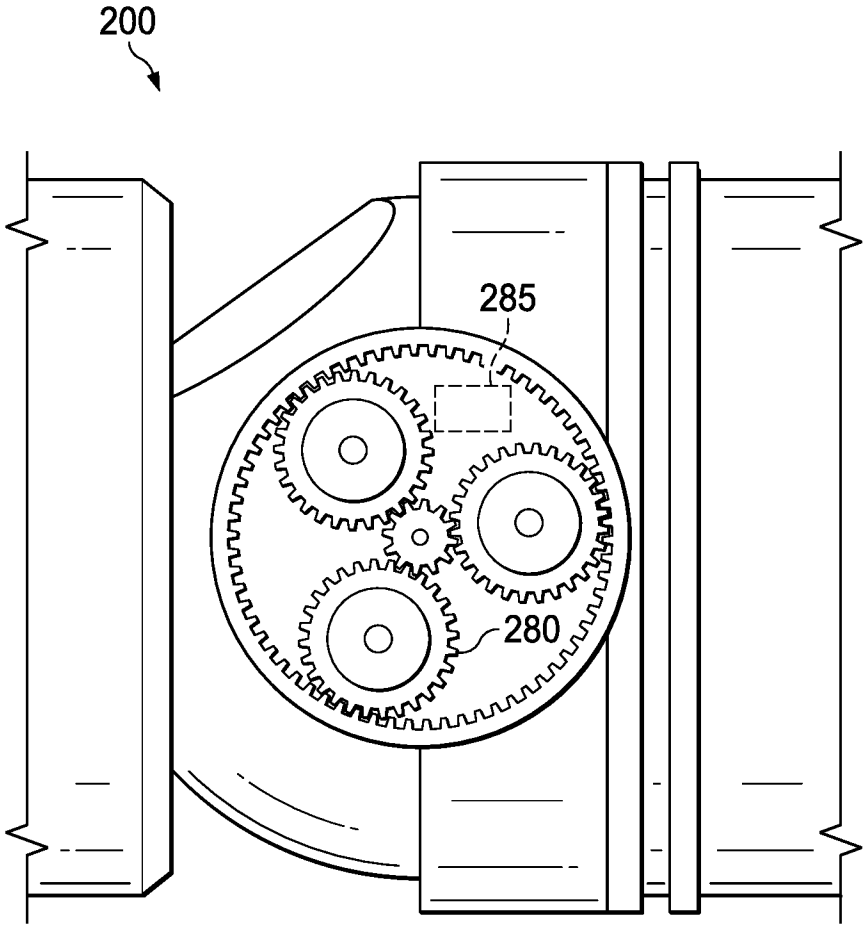
FIG. 3 illustrates an exterior view of the valve assembly illustrated in FIG. 2.

Turning to FIG. 3, illustrated is an exterior view of the valve assembly 200 illustrated in FIG. 2. As is illustrated in FIG. 3, the valve assembly 200 may additionally include a primary actuation member 280 coupled to the ball valve member 230. In this embodiment, the primary actuation member 280 would be separate from the secondary linear actuation member 260, and thus the primary actuation member 280 would initiate a movement of the ball valve member 230 from the valve open position toward the valve closed position, and the secondary linear actuation member 230 could then finalize the movement of the ball valve member 230 to the valve closed position. Any type of primary actuation member 280 may be used and remain within the scope of the present disclosure. Notwithstanding, one particular embodiment consistent with the disclosure employs a locally powered electric ball valve mechanism as the primary actuation member 280.

The valve assembly 200 illustrated in FIG. 3, additionally includes a sensor 285 positioned proximate the ball valve member 230. The sensor 285, in this embodiment, is configured to sense a predetermined event, and based thereon the linear actuation member 260 may be deployed. The sensor 285 may comprise a variety of different sensors and remain within the scope of the disclosure. In one particular example, the sensor 285 is a rotational sensor configured to sense for a predetermined event, such as a rotational location of the ball valve member 230. Such a rotational sensor could be used to deploy the linear actuation member 260 when the sensor 285 senses the ball valve member 230 achieves a desired amount of rotation. In an alternative embodiment, the sensor 285 is a torque sensor configured to sense for a predetermined event, such as a torque value of the primary actuation member 280. Such a torque sensor could be used to deploy the linear actuation member 260 when the sensor 285 senses a level of torque on the primary actuation member 280. Nevertheless, other sensors 285 are within the scope of the disclosure.

Figure 4:
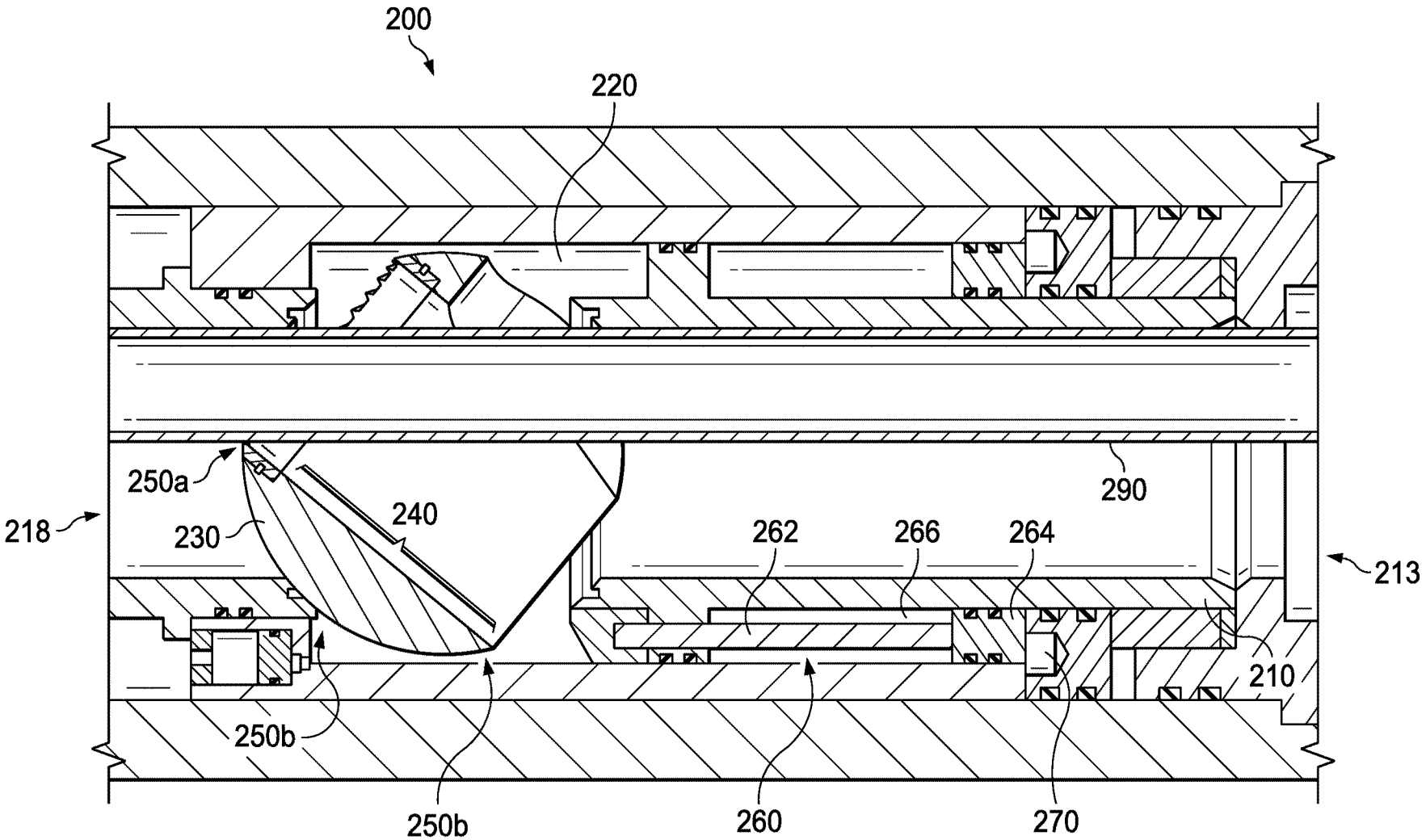
FIGS. 4-6 illustrate sectional views of the valve assembly of FIGS. 2 and 3 at various different stages of open and closure.
Figure 5:
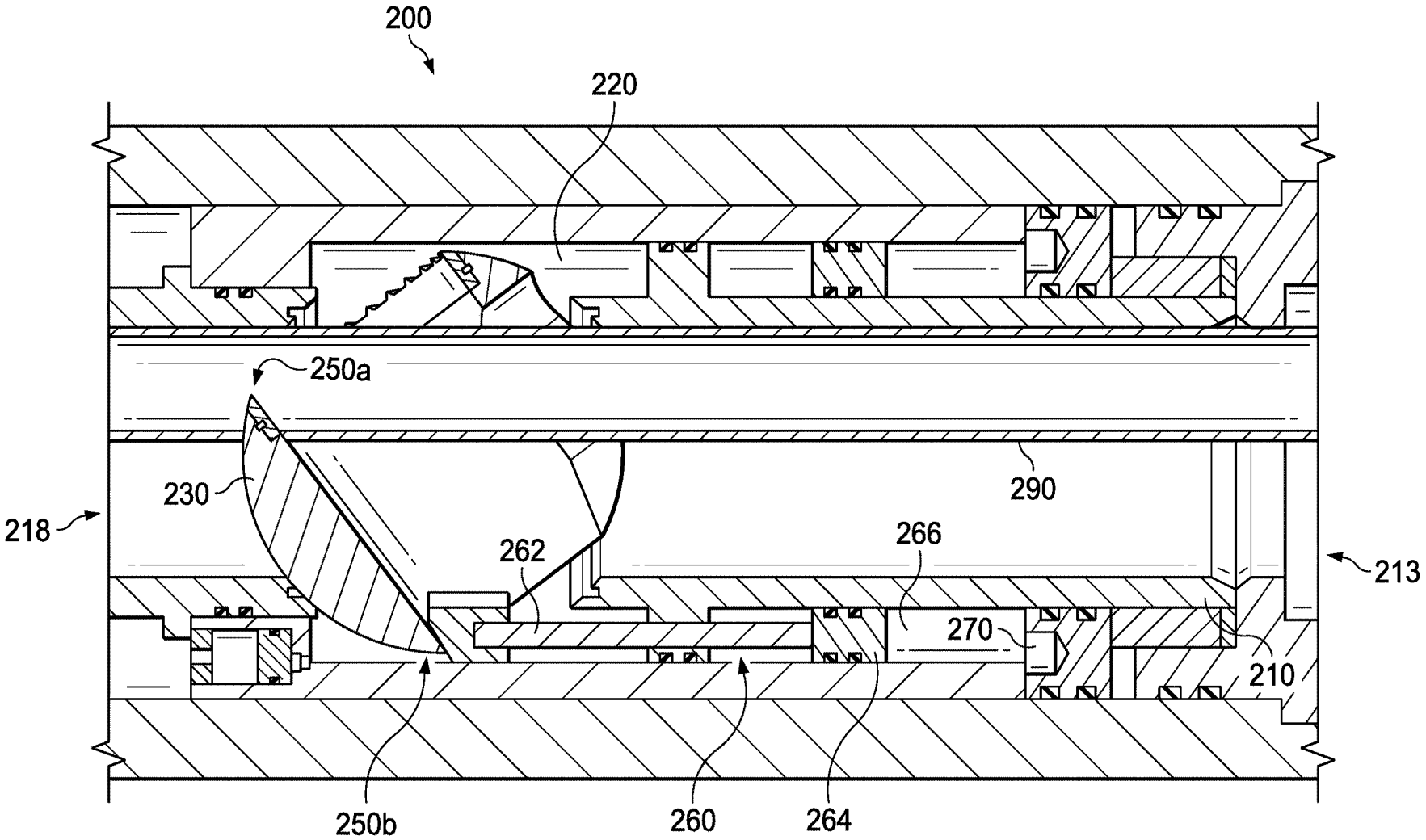
Figure 6:
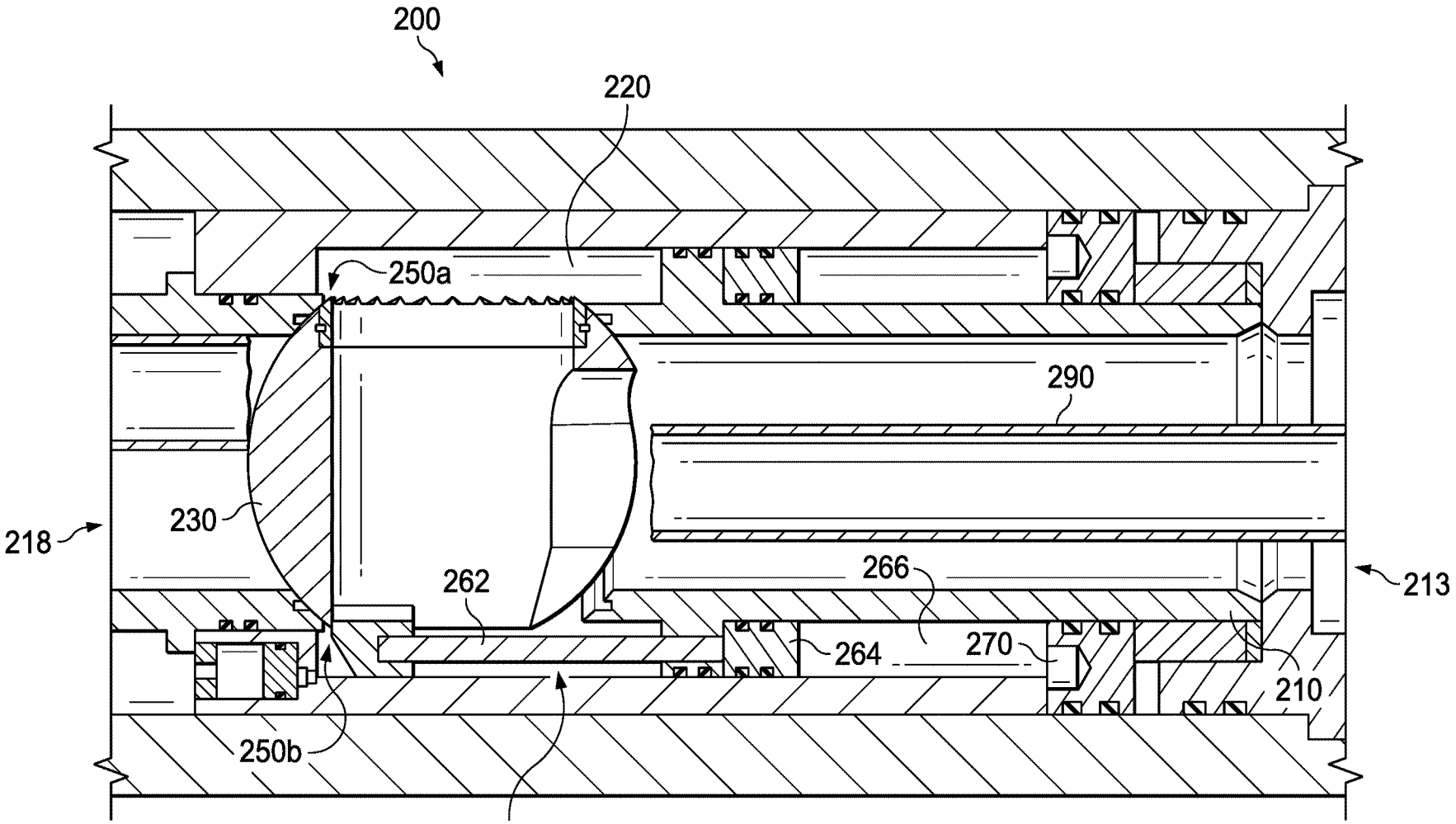

Turning now to FIGS. 4-6, illustrated are sectional views of the valve assembly 200 of FIGS. 2 and 3 at various different stages of open and closure, and having a downhole conveyance 290 axially positioned therein. The downhole conveyance 290, in the illustrated embodiment, is a length of coiled tubing extending through the bore 240 in the ball valve member 230. While the downhole conveyance 290 is illustrated as coiled tubing, other embodiments may exist wherein the downhole conveyance 290 is wireline, slickline, etc., without departing from the scope of the disclosure. Accordingly, the present disclosure should not be limited to any specific types of downhole conveyance 290, and in fact can extend to any wellbore tool that may extend through the bore 240 in the ball valve member 230.

In the illustrated embodiment of FIG. 4, the valve assembly 200, and more particularly the ball valve member 230, is at a rotational position after activating the primary actuation member 280 to initiate a movement of the ball valve member 230 from the valve fully open position (e.g., illustrated in FIG. 2) toward the valve partially closed position. For example, the ball valve member 230 illustrated in FIG. 4 is rotated such that the leading edge ball/bore interface 250*a* is proximate with, if not just in contact with, the downhole conveyance 290. At this stage, the primary actuation member 280 might lack the torque necessary to shear the downhole conveyance 290, and thus the rotation might stop. In another embodiment, the sensor 285 might sense a predetermined event (e.g., a rotational angle of the ball valve member 230, a torque of the primary actuation member 280, etc.) and stop the rotation of ball valve member 230 using the primary actuation member 280.

In the illustrated embodiment of FIG. 5, the valve assembly 200, and more particularly the ball valve member 230, is at a rotational position just after activating the secondary linear actuation member 260 to finalize the movement of the ball valve member 230 to the valve closed position. For example, the propellant charge 270 could be discharged to push the piston 264, and thus push rod 262, toward the trailing edge of the ball/bore interface 250*b*. As discussed above, the secondary linear actuation member 260 may be activated using the propellant charge 270, or another source of linear movement. In the illustrated embodiment, by activating the secondary linear actuation member 260, the leading edge ball/bore interface 250*a* is provided with a sufficient amount of torque to sever the downhole conveyance 290. In the illustrated embodiment of FIG. 6, the valve assembly 200, and more particularly the ball valve member 230, is at a rotational position after finalizing its movement to the valve closed position, and thus fully severing the downhole conveyance 290.

Figure 7:
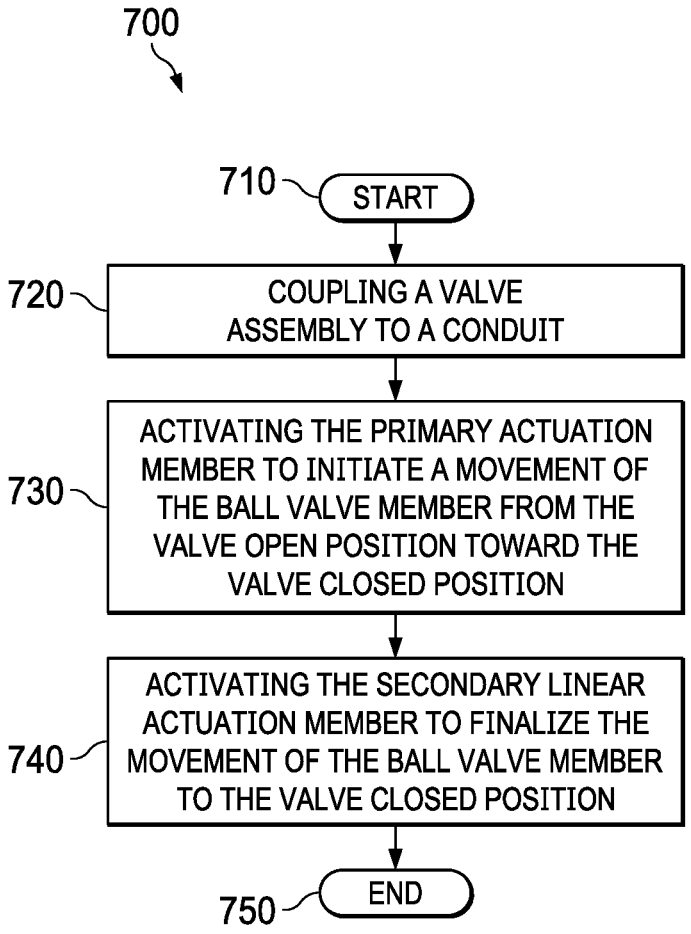
FIG. 7 illustrates a flow diagram depicting a method for actuating a valve assembly between an open position and a closed position according to one embodiment of the disclosure.

Turning to FIG. 7, illustrated is a flow diagram 700 depicting a method for actuating a valve assembly between an open position and a closed position according to one embodiment of the disclosure. The method begins in a start step 710. Thereafter, in a step 720, a valve assembly according to the disclosure is coupled to a conduit. With the valve assembly in place, the primary actuation member may be activated to initiate a movement of the ball valve member from the valve open position toward the valve closed position in a step 730. Thereafter, in a step 740, the secondary linear actuation member may be activated to finalize the movement of the ball valve member to the valve closed position. With the ball valve member in the valve closed position, the method may complete in a stop step 750.

Aspects disclosed herein include:

A. A valve assembly, the valve assembly including a valve body having inlet and outlet flow passageways connected by a valve chamber, a ball valve member having a bore there through creating a ball/bore interface, the ball valve member located in the valve chamber for selective rotation between valve open and valve closed positions to control flow through the valve assembly, and a linear actuation member slideable to engage proximate the ball/bore interface to assist in moving the ball valve member to the valve closed position.

B. A method for actuating a valve assembly between an open position and a closed position, the method including coupling a valve assembly to a conduit, the valve assembly including 1) a valve body having inlet and outlet flow passageways connected by a valve chamber, 2) a ball valve member having a bore there through creating a ball/bore interface, the ball valve member located in the valve chamber for selective rotation between valve open and valve closed positions to control flow through the valve assembly, 3) a primary actuation member coupled to the ball valve member, and 4) a separate secondary linear actuation member slideable to engage proximate the ball/bore interface, activating the primary actuation member to initiate a movement of the ball valve member from the valve open position toward the valve closed position, and activating the secondary linear actuation member to finalize the movement of the ball valve member to the valve closed position.

Aspects A and B may have one or more of the following additional elements in combination: Element 1: wherein the linear actuation member is a hydraulically or pneumatically controlled linear actuation member. Element 2: wherein the linear actuation member is a propellant charge controlled linear actuation member. Element 3: wherein the linear actuation member is an electrically controlled linear actuation member. Element 4: wherein the linear actuation member includes a push or pull rod coupled to a piston positioned within a piston chamber, and further wherein the push or pull rod is slideable to engage proximate the ball/bore interface. Element 5: wherein the linear actuation member is a push rod slideable to engage a trailing edge of the ball/bore interface. Element 6: wherein linear actuation member is a push rod slideable to engage a leading edge of the ball/bore interface. Element 7: wherein the linear actuation member is a secondary linear actuation member, and further including a primary actuation member coupled to the ball valve member. Element 8: wherein the primary actuation member is configured to initiate a movement of the ball valve member from the valve open position toward the valve closed position and the secondary linear actuation member is configured to finalize the movement of the ball valve member to the valve closed position. Element 9: further including a sensor positioned proximate the ball valve member, the sensor configured to sense a predetermined event for deployment of the linear actuation member. Element 10: wherein the sensor is a rotational sensor. Element 11: wherein the sensor is a torque sensor. Element 12: wherein activating the secondary linear actuation member includes activating the secondary linear actuation member using hydraulics or pneumatics. Element 13: wherein activating the secondary linear actuation member includes activating the secondary linear actuation member using a propellant charge. Element 14: wherein the secondary linear actuation member includes a push or pull rod coupled to a piston positioned within a piston chamber, and further wherein the push or pull rod slides to engage proximate the ball/bore interface when activating the secondary linear actuation member. Element 15: wherein the secondary linear actuation member is a push rod that slides to engage a trailing edge of the ball/bore interface. Element 16: further including a sensor positioned proximate the ball valve member, and wherein activating the secondary linear actuation member includes activating the secondary linear actuation member when the sensor senses a predetermined event. Element 17: wherein the sensor is a rotational sensor and the predetermined event is a sensed rotational angle of the ball valve member. Element 18: wherein the sensor is a torque sensor and the predetermined event is a sensed torque of the primary actuation member. Element 19: further including increasing the wellbore pressure to reset the second linear actuation member after activating the secondary linear actuation member to finalize the movement of the ball valve member to the valve closed position.

Those skilled in the art to which this application relates will appreciate that other and further additions, deletions, substitutions and modifications may be made to the described embodiments.

What is claimed is:

1. A valve assembly, comprising:

a valve body having inlet and outlet flow passageways connected by a valve chamber;

a ball valve member having a bore there through creating a ball/bore interface, the ball valve member located in the valve chamber for selective rotation between valve open and valve closed positions to control flow through the valve assembly; and a linear actuation member slideable to engage the bore or the ball/bore interface to assist in moving the ball valve member to the valve closed position.

2. The valve assembly as recited in claim 1, wherein the linear actuation member is a hydraulically or pneumatically controlled linear actuation member.

3. The valve assembly as recited in claim 1, wherein the linear actuation member is a propellant charge controlled linear actuation member.

4. The valve assembly as recited in claim 1, wherein the linear actuation member is an electrically controlled linear actuation member.

5. The valve assembly as recited in claim 1, wherein the linear actuation member includes a push or pull rod coupled to a piston positioned within a piston chamber, and further wherein the push or pull rod is slideable to engage proximate the ball/bore interface.

6. The valve assembly as recited in claim 5, wherein the linear actuation member is a push rod slideable to engage a trailing edge of the ball/bore interface.

7. The valve assembly as recited in claim 5, wherein linear actuation member is a push rod slideable to engage a leading edge of the ball/bore interface.

8. The valve assembly as recited in claim 1, wherein the linear actuation member is a secondary linear actuation member, and further including a primary actuation member coupled to the ball valve member.

9. The valve assembly as recited in claim 8, wherein the primary actuation member is configured to initiate a movement of the ball valve member from the valve open position toward the valve closed position and the secondary linear actuation member is configured to finalize the movement of the ball valve member to the valve closed position.

10. The valve assembly as recited in claim 1, further including a sensor positioned proximate the ball valve member, the sensor configured to sense a predetermined event for deployment of the linear actuation member.

11. The valve assembly as recited in claim 10, wherein the sensor is a rotational sensor.

12. The valve assembly as recited in claim 10, wherein the sensor is a torque sensor.

13. A method, comprising:

coupling a valve assembly to a conduit, the valve assembly including:

a valve body having inlet and outlet flow passageways connected by a valve chamber;

a ball valve member having a bore there through creating a ball/bore interface, the ball valve member located in the valve chamber for selective rotation between valve open and valve closed positions to control flow through the valve assembly;

a primary actuation member coupled to the ball valve member; and a separate secondary linear actuation member slideable to engage the bore or the ball/bore interface; and activating the primary actuation member to initiate a movement of the ball valve member from the valve open position toward the valve closed position; and activating the secondary linear actuation member to finalize the movement of the ball valve member to the valve closed position.

14. The method as recited in claim 13, wherein activating the secondary linear actuation member includes activating the secondary linear actuation member using hydraulics or pneumatics.

15. The method as recited in claim 13, wherein activating the secondary linear actuation member includes activating the secondary linear actuation member using a propellant charge.

16. The method as recited in claim 13, wherein the secondary linear actuation member includes a push or pull rod coupled to a piston positioned within a piston chamber, and further wherein the push or pull rod slides to engage proximate the ball/bore interface when activating the secondary linear actuation member.

17. The method as recited in claim 16, wherein the secondary linear actuation member is a push rod that slides to engage a trailing edge of the ball/bore interface.

18. The method as recited in claim 13, further including a sensor positioned proximate the ball valve member, and wherein activating the secondary linear actuation member includes activating the secondary linear actuation member when the sensor senses a predetermined event.

19. The method as recited in claim 18, wherein the sensor is a rotational sensor and the predetermined event is a sensed rotational angle of the ball valve member.

20. The method as recited in claim 18, wherein the sensor is a torque sensor and the predetermined event is a sensed torque of the primary actuation member.

21. The method as recited in claim 13, further including increasing the wellbore pressure to reset the second linear actuation member after activating the secondary linear actuation member to finalize the movement of the ball valve member to the valve closed position.

* * * * *